US010655842B2

(12) United States Patent
Björklund et al.

(10) Patent No.: US 10,655,842 B2
(45) Date of Patent: May 19, 2020

(54) BURNER AND FINE SOLIDS FEEDING APPARATUS FOR A BURNER

(71) Applicant: OUTOTEC (FINLAND) OY, Espoo (FI)

(72) Inventors: Peter Björklund, Espoo (FI); Elli Miettinen, Espoo (FI); Aki Laaninen, Espoo (FI); Sarianna Suominen, Espoo (FI); Kaj Eklund, Espoo (FI)

(73) Assignee: OUTOTEC (FINLAND) OY, Espoo (FI)

( * ) Notice: Subject to any disclaimer, the term of this patent is extended or adjusted under 35 U.S.C. 154(b) by 99 days.

(21) Appl. No.: 15/770,510

(22) PCT Filed: Oct. 28, 2016

(86) PCT No.: PCT/FI2016/050756
§ 371 (c)(1),
(2) Date: Apr. 24, 2018

(87) PCT Pub. No.: WO2017/072413
PCT Pub. Date: May 4, 2017

(65) Prior Publication Data

US 2018/0224119 A1 Aug. 9, 2018

(30) Foreign Application Priority Data

Oct. 30, 2015 (FI) ..... 20155773

(51) Int. Cl.
*F23D 1/02* (2006.01)
*F23C 7/00* (2006.01)
*F23D 1/00* (2006.01)

(52) U.S. Cl.
CPC ..... *F23D 1/02* (2013.01); *F23C 7/002* (2013.01); *F23D 1/00* (2013.01); *F23D 2201/20* (2013.01)

(58) Field of Classification Search
USPC ..... 431/8
See application file for complete search history.

(56) References Cited

U.S. PATENT DOCUMENTS 2,335,188 A * 11/1943 Kennedy ..... F23D 1/00 431/284
4,147,535 A * 4/1979 Lilja ..... B01F 3/06 266/172

(Continued)

FOREIGN PATENT DOCUMENTS

EP 2 113 717 A2 11/2009
JP 2012-112549 A 6/2012

(Continued)

OTHER PUBLICATIONS

International Search Report (PCT/ISA/210) dated Feb. 10, 2017, by the Finnish Patent Office as the International Searching Authority for International Application No. PCT/FI2016/050756.

(Continued)

*Primary Examiner* — Edelmira Bosques
*Assistant Examiner* — Nikhil P Mashruwala
(74) *Attorney, Agent, or Firm* — Buchanan Ingersoll & Rooney PC

(57) ABSTRACT

Provided are a burner such as a concentrate burner, a calcine burner, or a matte burner, or a burner using a mixture of these for feeding reaction gas and fine solids into a reaction shaft of a suspension smelting furnace, and a fine solids feeding apparatus for a burner such as a concentrate burner, a calcine burner, or a matte burner, or a burner using a mixture of these. The fine solids feeding apparatus comprises gas outlets in a fine solids discharge channel upstream of a downstream outlet end of the fine solids discharge channel. The gas outlets comprise spiral path guiding members configured to facilitate gas to flow from the gas outlets (Continued)

Figure 1:
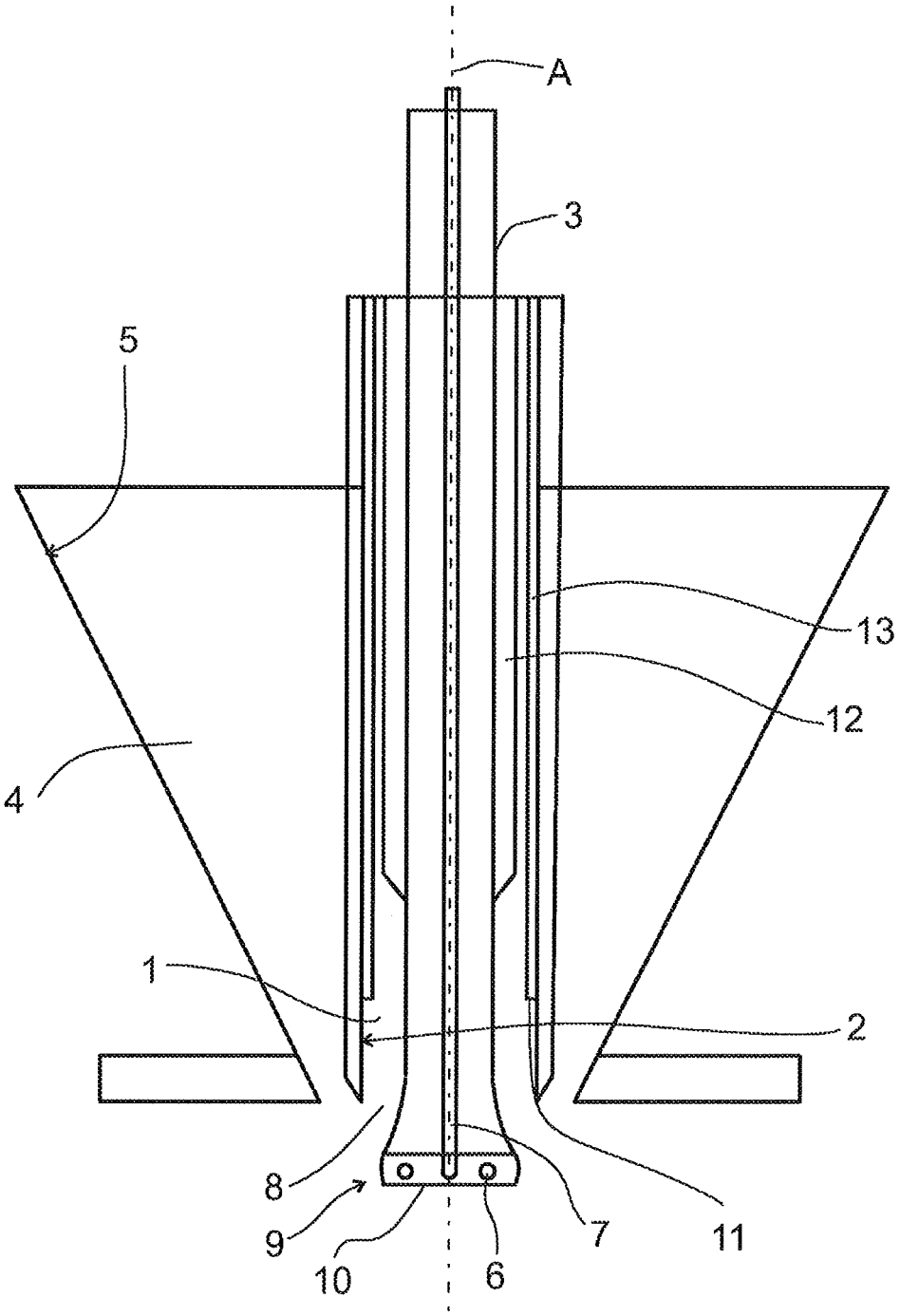

in a spiral flow path around a center axis A of the fine solids discharge channel.

11 Claims, 12 Drawing Sheets

(56) References Cited

U.S. PATENT DOCUMENTS 4,208,180 A * 6/1980 Nakayasu ..... F23D 17/007 239/404
4,679,512 A * 7/1987 Skoog ..... F23C 7/004 110/262
5,055,032 A * 10/1991 Altemark ..... F23D 14/20 431/154
5,090,339 A * 2/1992 Okiura ..... F23D 1/00 110/263
5,358,222 A * 10/1994 Kaasinen ..... F23C 7/00 266/135
6,116,171 A * 9/2000 Oota ..... F23C 6/045 110/263
6,238,457 B1 * 5/2001 Holmi ..... C22B 15/0028 75/455
6,315,551 B1 * 11/2001 Salzsieder ..... F23D 14/24 239/400
7,739,967 B2 6/2010 Briggs, Jr. et al.
8,147,747 B2 * 4/2012 Wang ..... C22B 13/02 110/182.5
9,039,407 B2 * 5/2015 McKnight ..... F23C 6/045 431/36
9,689,610 B2 * 6/2017 Motomura ..... F27D 3/16
9,957,586 B2 * 5/2018 Sipila ..... F27D 3/16
10,458,685 B2 * 10/2019 Wilkerson ..... F25B 40/04
2007/0048679 A1 * 3/2007 Joshi ..... F23C 6/047 431/8
2009/0272822 A1 * 11/2009 Davis ..... F23D 1/00 239/502
2009/0305971 A1 * 12/2009 Sessa ..... C07K 14/705 514/1.1
2010/0207307 A1 * 8/2010 Sipila ..... C22B 15/0047 266/175
2014/0011141 A1 * 1/2014 Matsumoto ..... F23D 1/00 431/12
2015/0061201 A1 3/2015 Jastrzebski et al.
2015/0091224 A1 4/2015 Motomura et al.
2016/0258685 A1 * 9/2016 Wesley ..... F23D 1/00
2018/0156541 A1 * 6/2018 Miettinen ..... F27D 99/0033

FOREIGN PATENT DOCUMENTS

WO WO 2013/149332 A1 10/2013
WO WO 2015/054739 A 4/2015
WO WO 2015/058283 A1 4/2015

OTHER PUBLICATIONS

International Preliminary Report on Patentability (PCT/IPEA/409) dated Oct. 12, 2017, by the Finnish Patent Office as the International Searching Authority for International Application No. PCT/FI2016/050756.
Finnish Search Report dated Apr. 20, 2016.

* cited by examiner

BURNER AND FINE SOLIDS FEEDING APPARATUS FOR A BURNER

FIELD OF THE INVENTION

Publication WO 2015/054739 presents a dispersion apparatus for use with a solid fuel burner. The dispersion apparatus comprises a passage through which particulate material may flow toward an outlet region for dispersal therefrom, the flow being at least in part rotational about the longitudinal axis of the passage. The dispersion apparatus also comprises a downstream guide means arranged within the passage at or near the outlet region, the downstream guide means configured to at least reduce the rotational motion so that the flow progresses toward the outlet region in a substantially uniform manner in a direction aligned with a longitudinal axis of the passage.

OBJECTIVE OF THE INVENTION

The object of the invention is to provide a burner and a fine solids feeding apparatus that provided for an even solids feed distribution.

SHORT DESCRIPTION OF THE INVENTION

The invention is based on inducing gas to flow in a spiral flow path upstream of the downstream outlet end of the fine solids discharge channel. This spiral flow path of gas causes fine solids flowing in the fine solids discharge channel downstream of the gas outlets to also flow in a spiral flow path. This spiral flow path of the fine solids evens out possible unevenness in a horizontal direction in the flow of fine solids, because a vertical direction of unevenness of the fine solid feed distribution will be overlapped partly with too little fine solid feed and partly with too much fine solid feed. Since reaction gas is fed in a vertical direction, the reaction gas will cross both the overlapped part with too little fine solid feed and the overlapping with too much fine solid feed. The vertical distribution inaccuracy, which is induced by the spiral flow path of the fine solids, occurs on such a small timescale that it does not influence the reaction shaft performance. The result of this is an even distribution of fine solids, which has a positive effect on the reaction between the reaction gas and the fine solids in the reaction shaft of the furnace. furnace.

Because gas is used to induce the spiral flow path of fine solids instead of mechanical spiral flow means, the flow of fine solids will be more even, because there are no mechanical means in the flowing path of the fine solids.

LIST OF FIGURES

Figure 2:
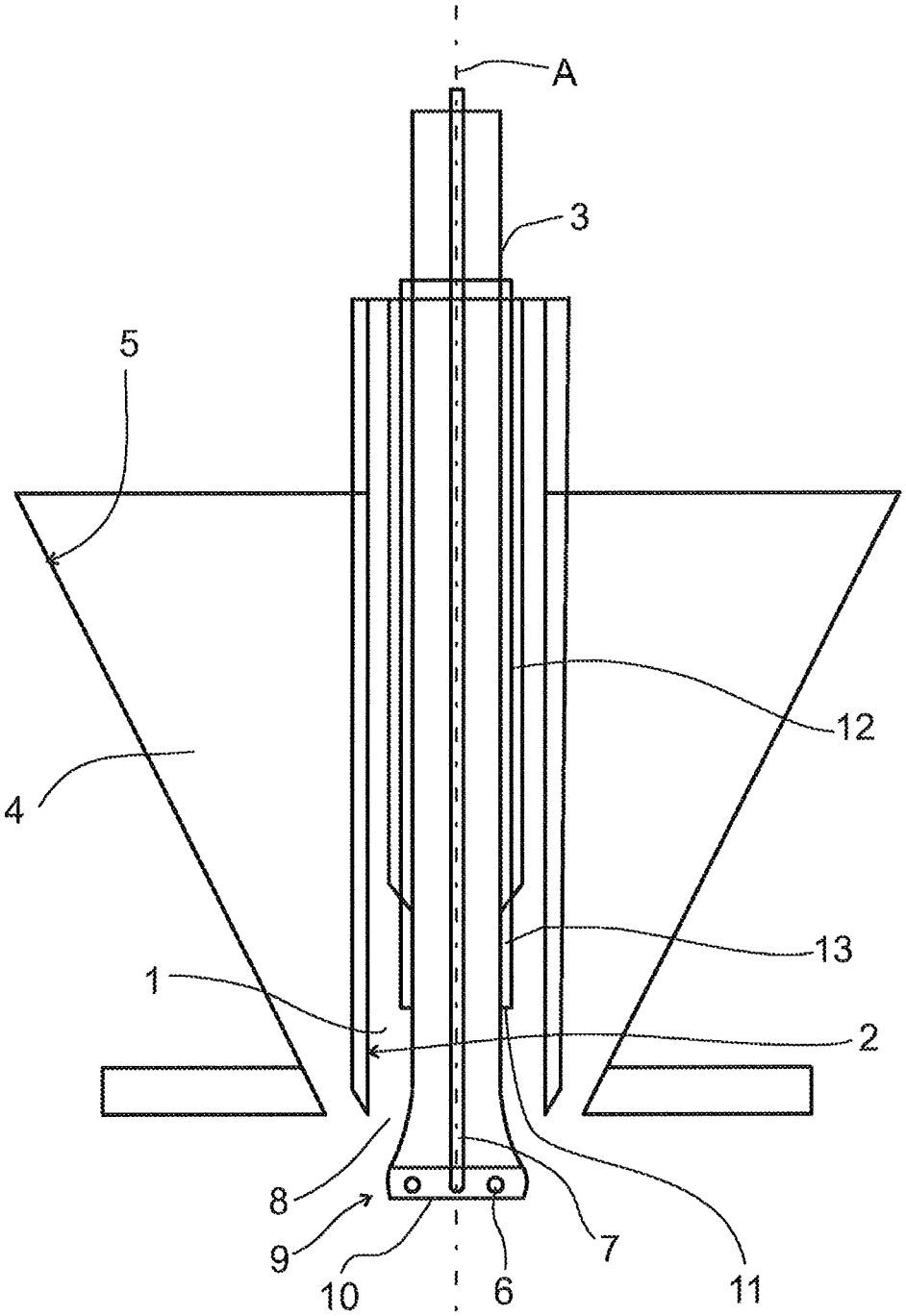
Figure 3:
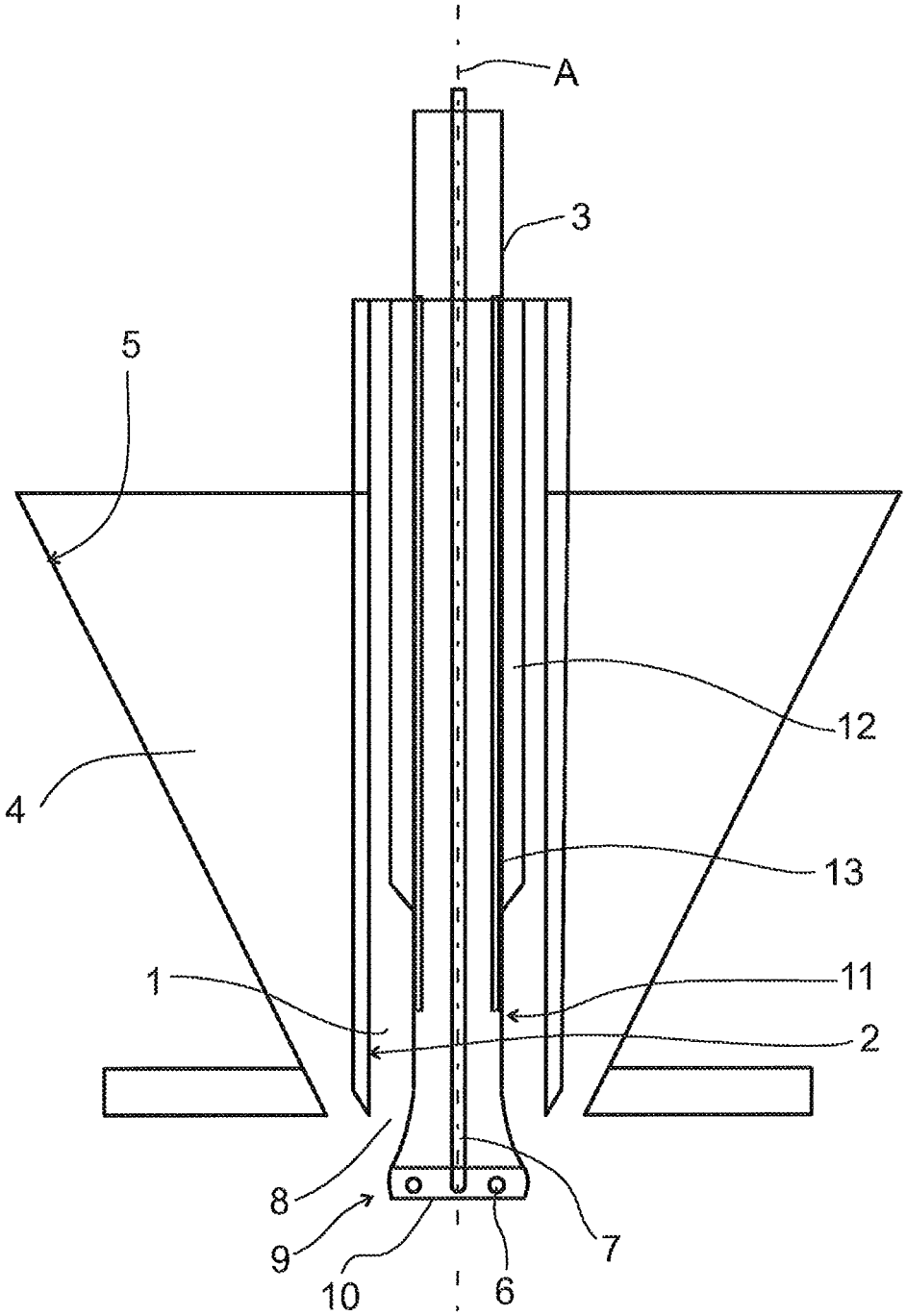
Figure 4:
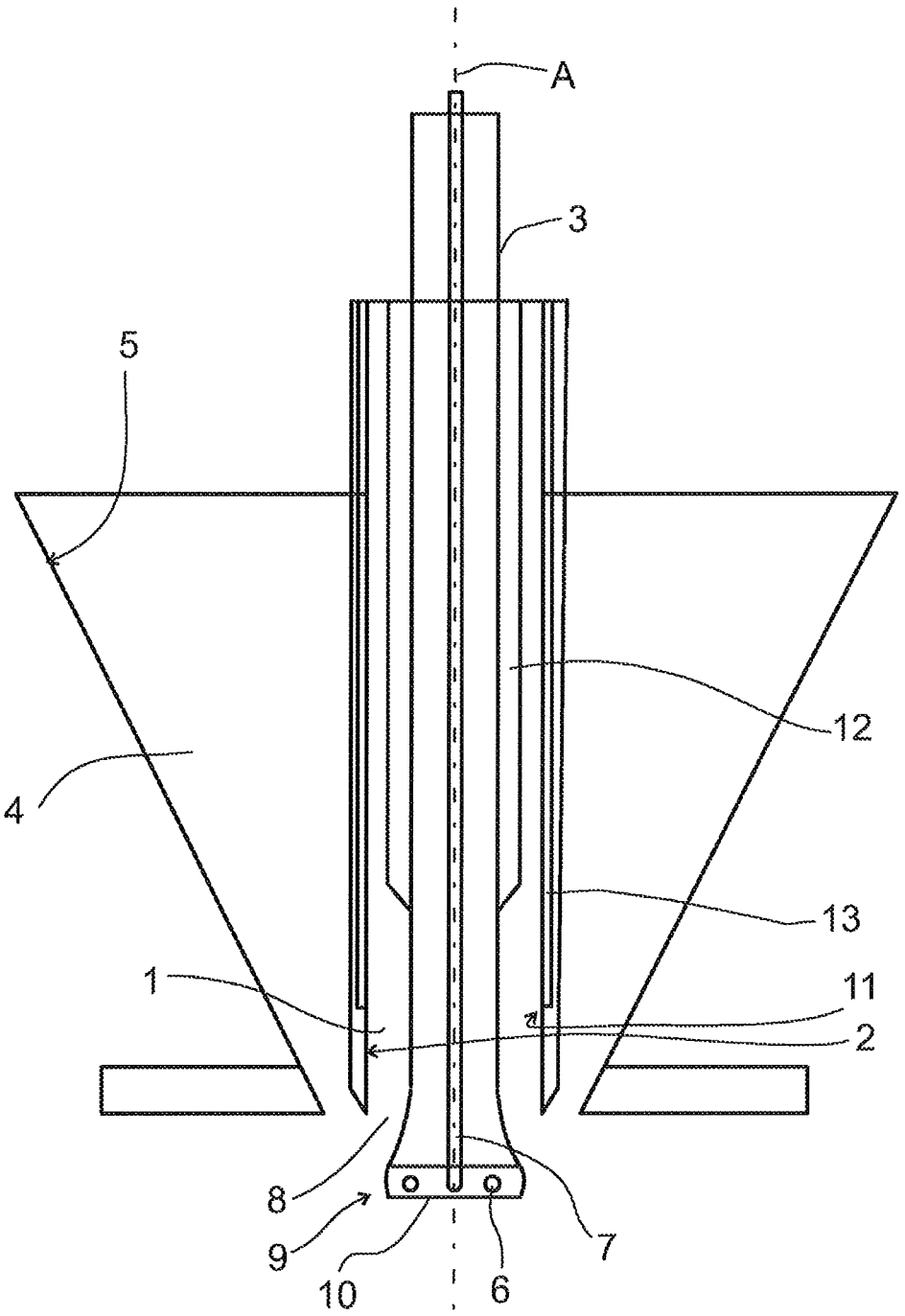
Figure 5:
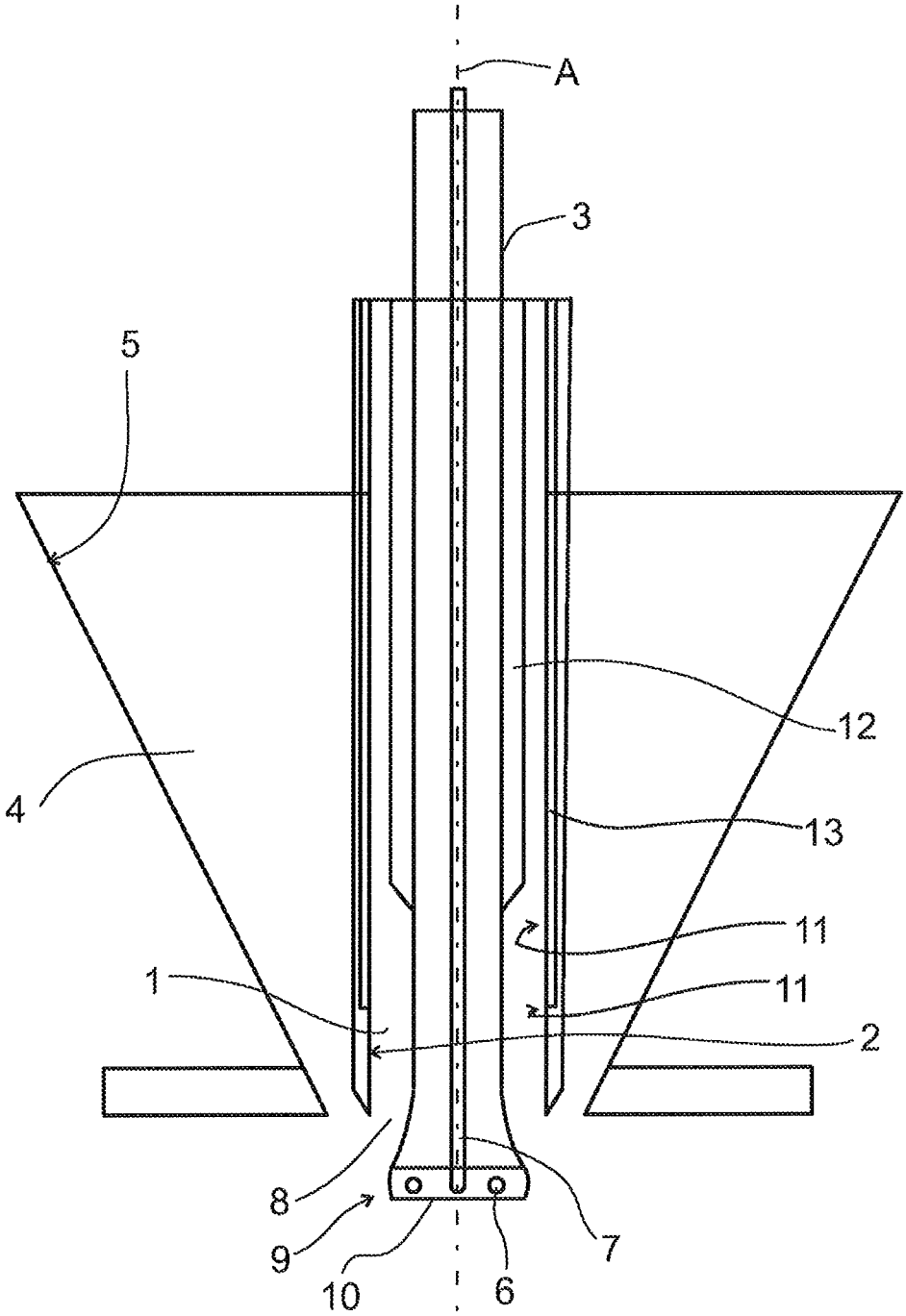
Figure 6:
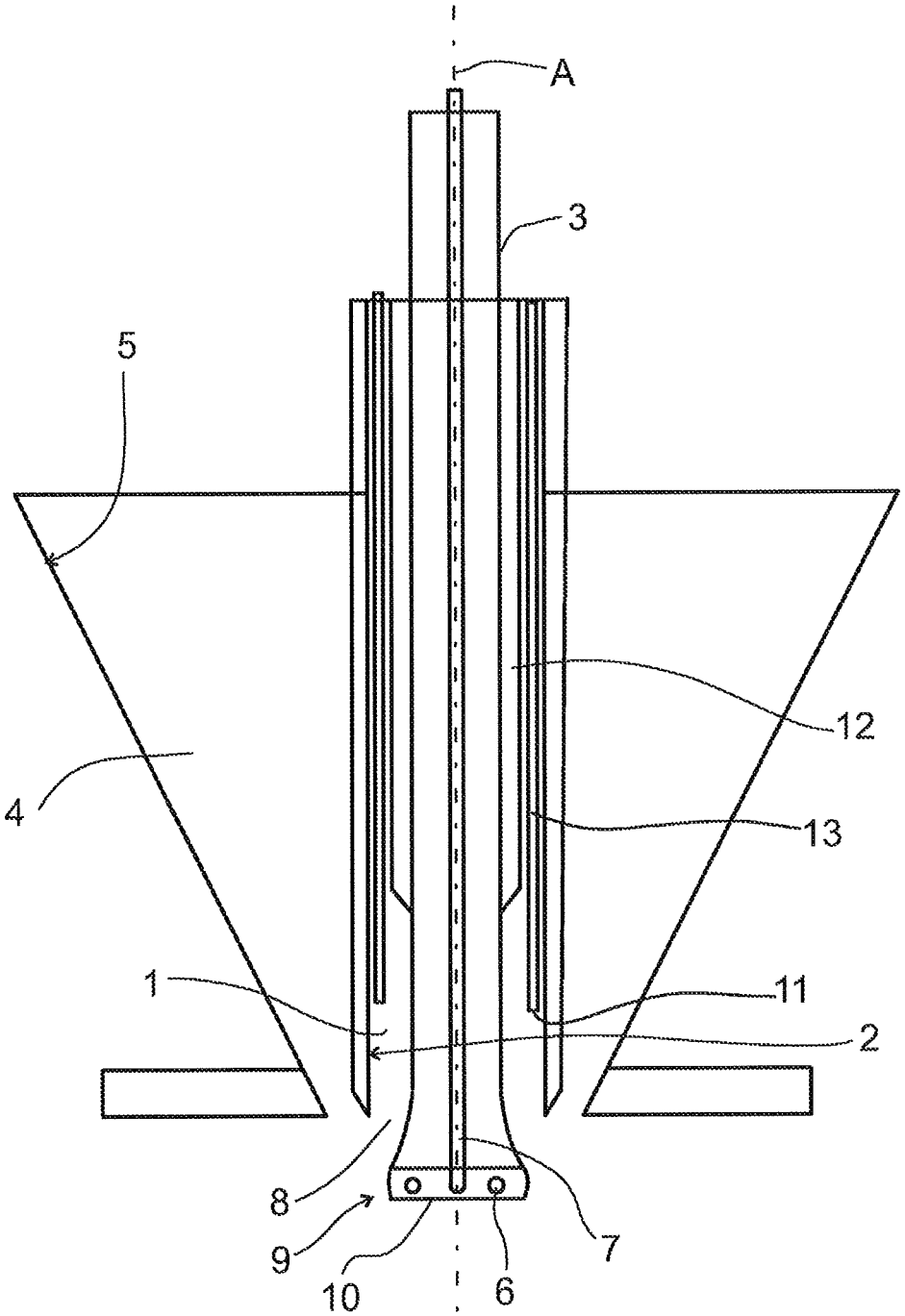
Figure 7:
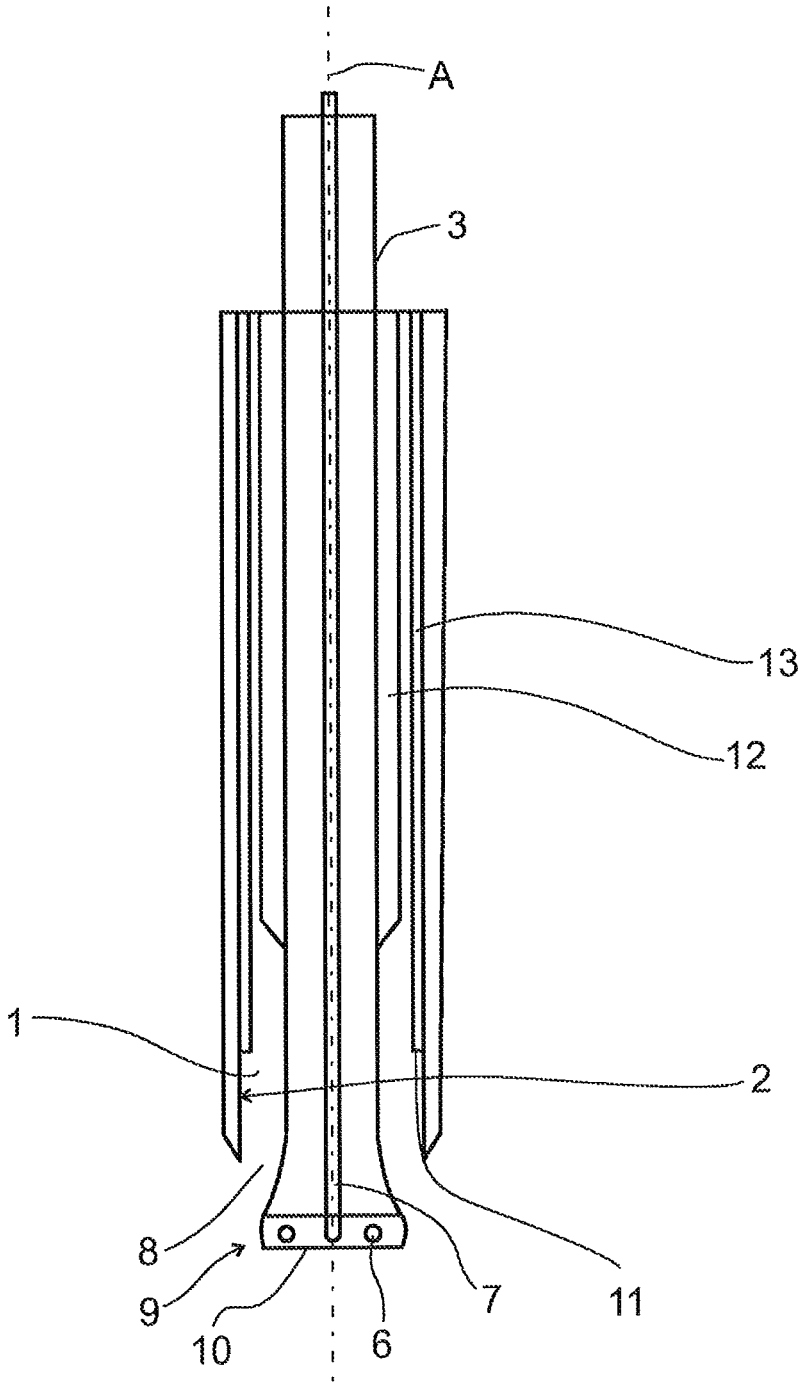
Figure 8:
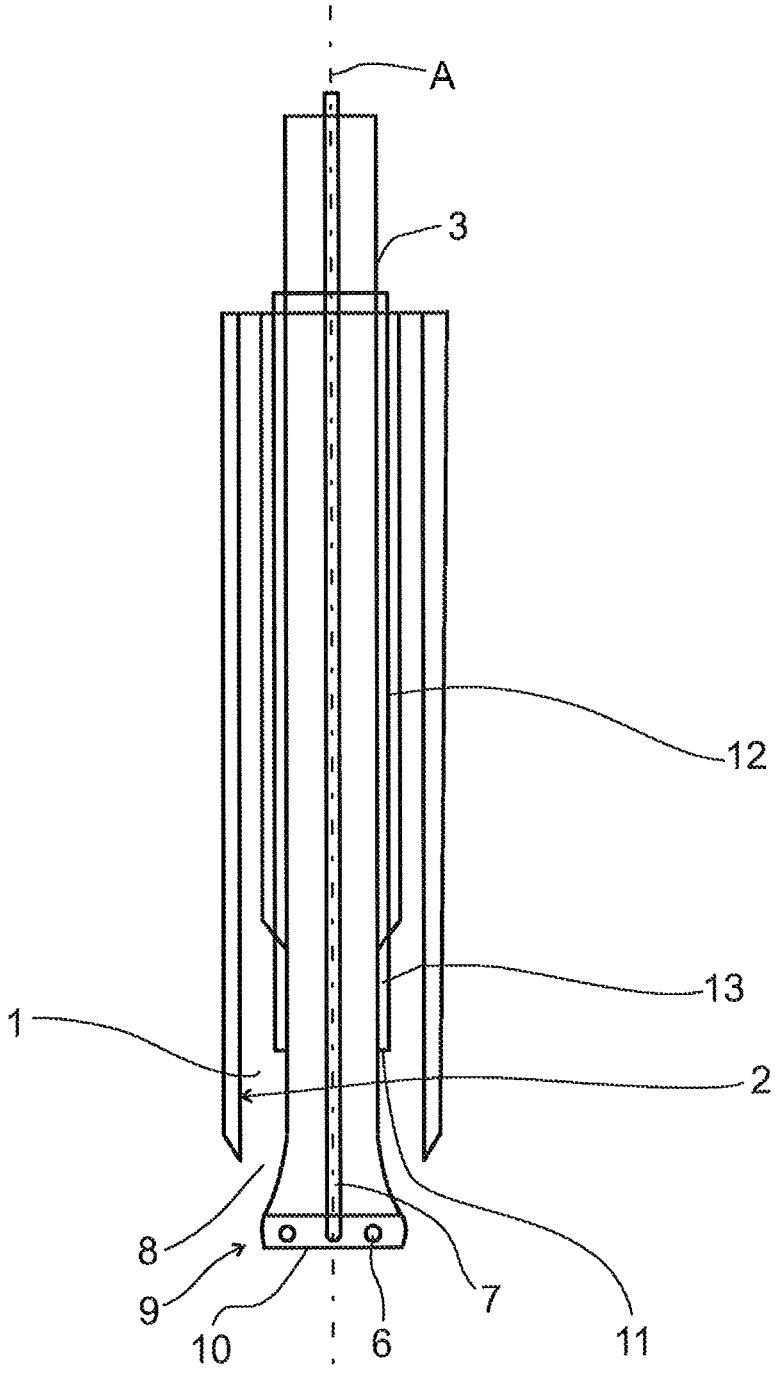
Figure 9:
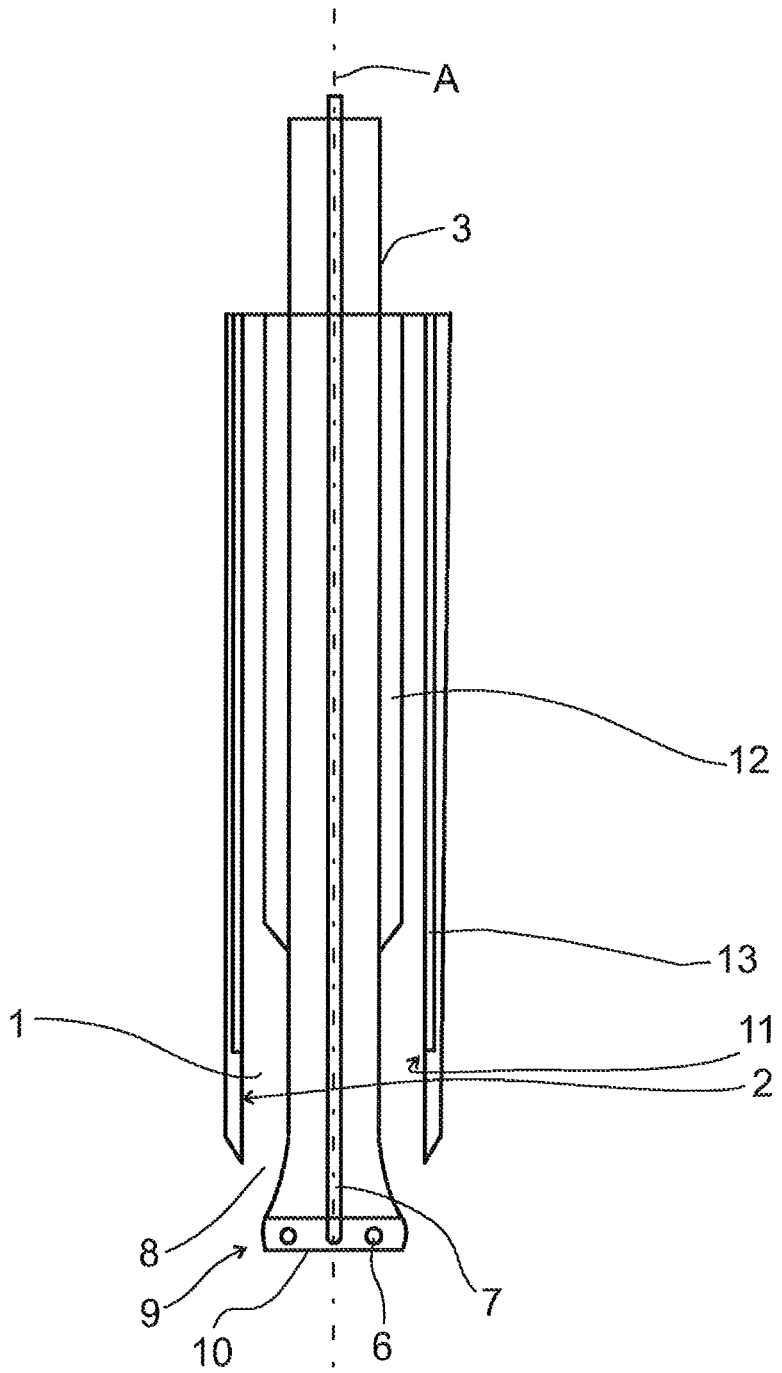
Figure 10:
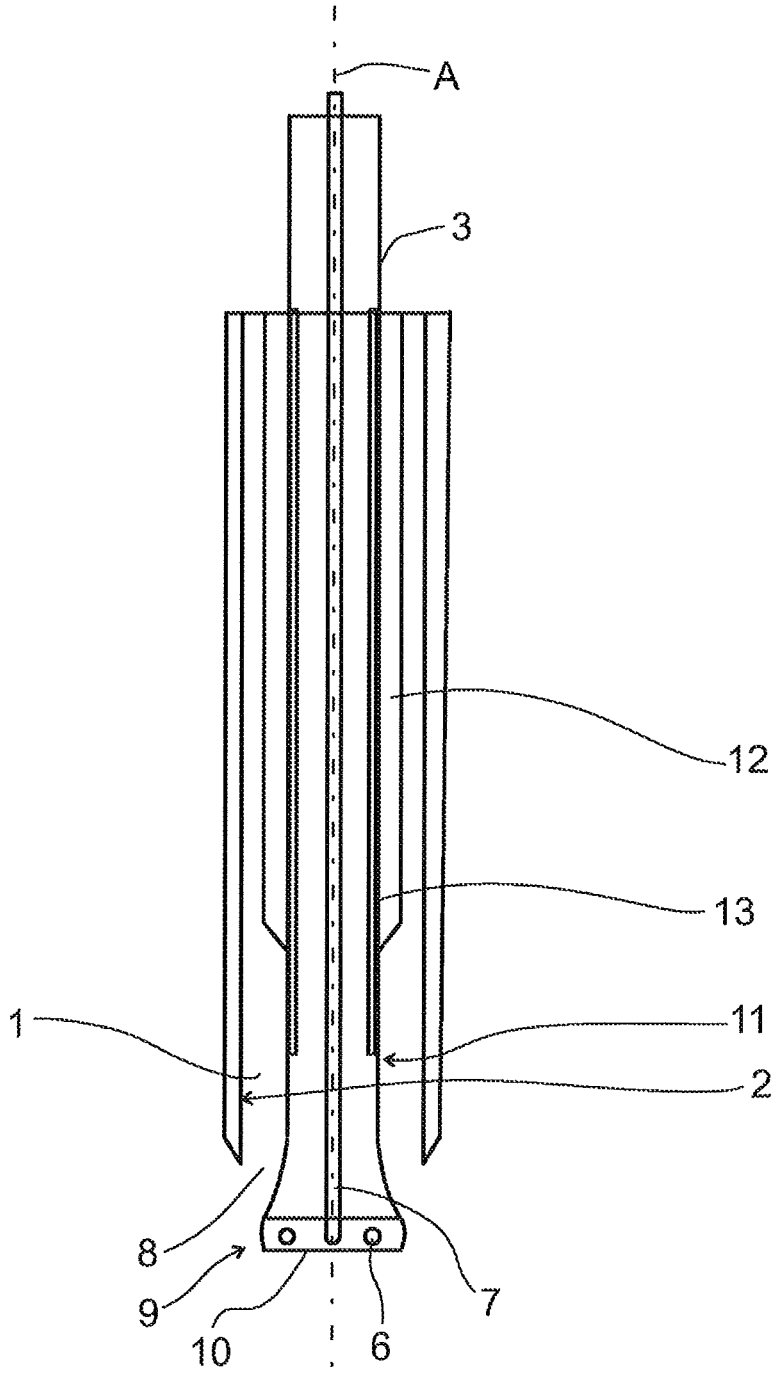
Figure 11:
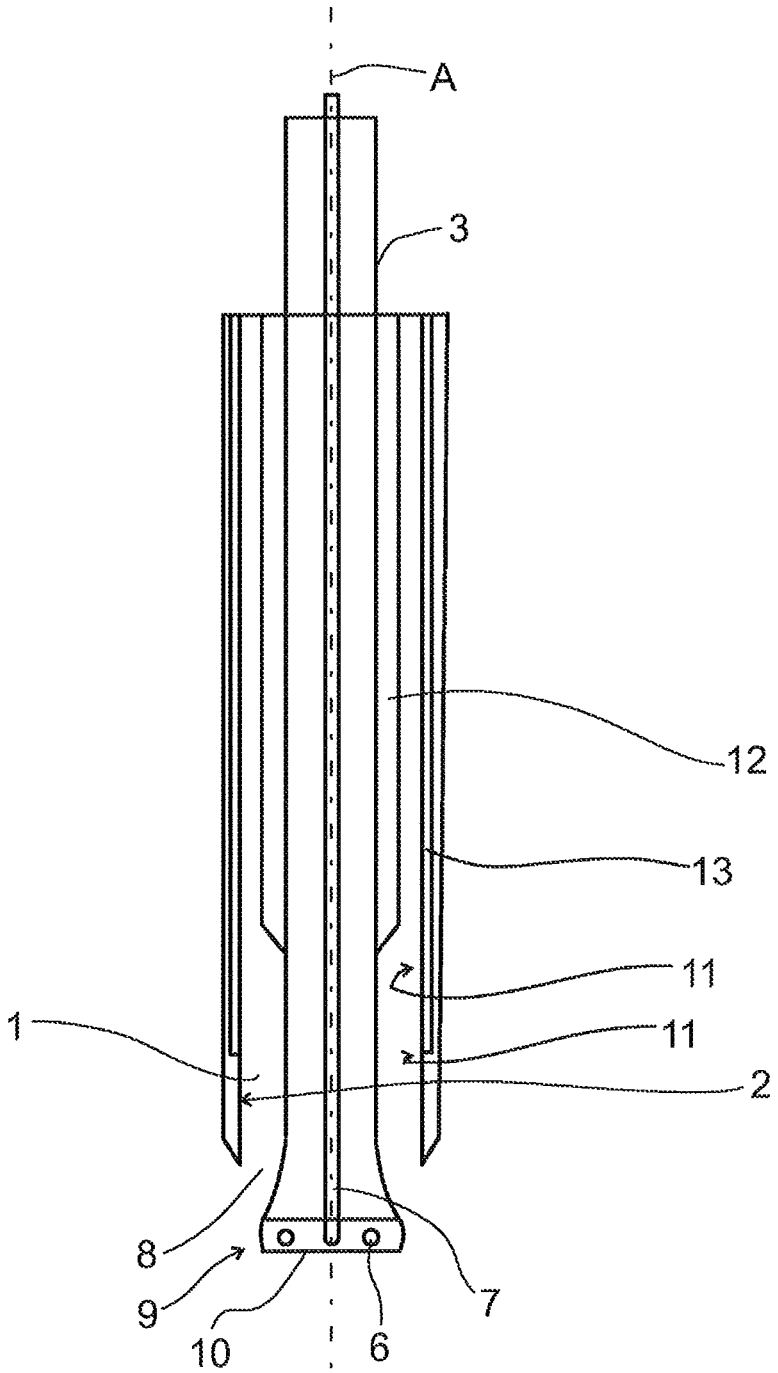
Figure 12:
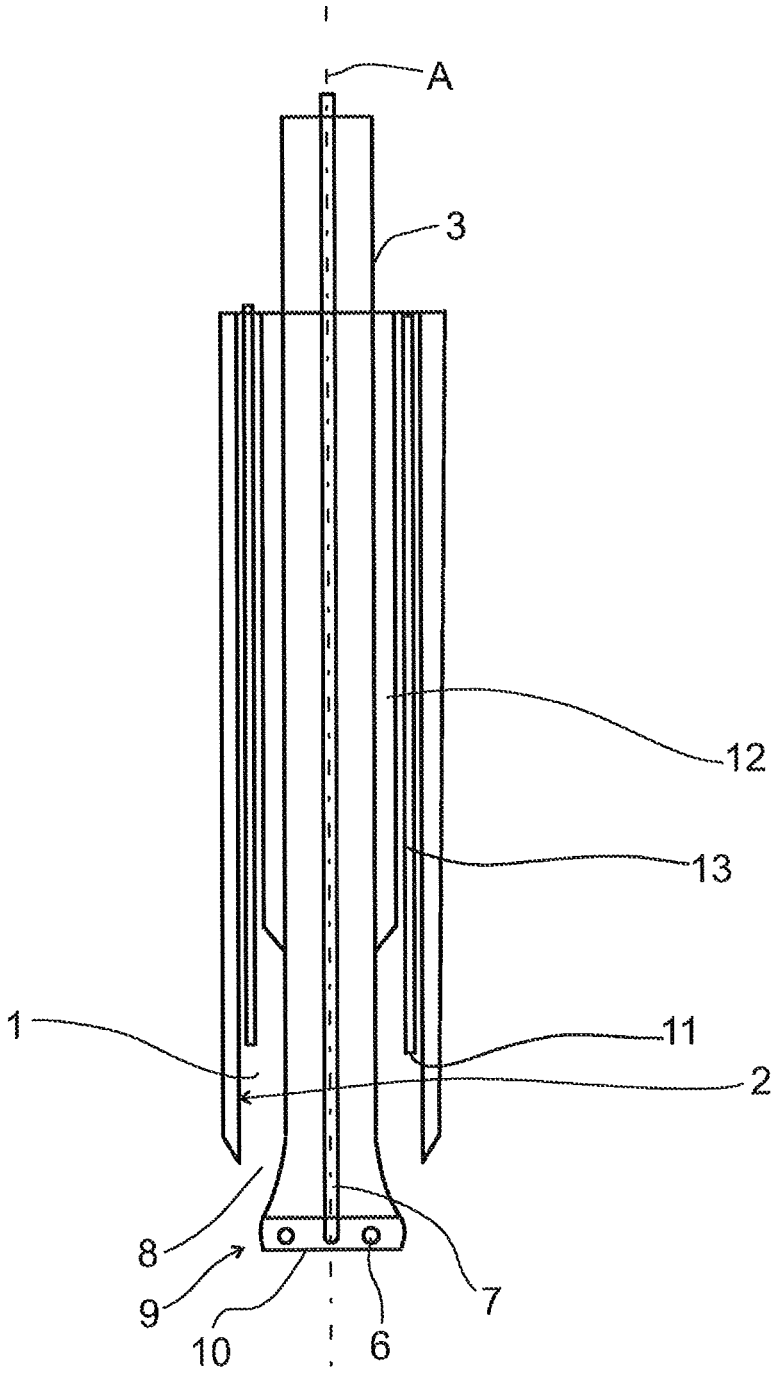

In the following the invention will described in more detail by referring to the figures, of which FIG. 1 shows a first embodiment of the burner, FIG. 2 shows a second embodiment of the burner, FIG. 3 shows a third embodiment of the burner, FIG. 4 shows a fourth embodiment of the burner, FIG. 5 shows a fifth embodiment of the burner, FIG. 6 shows a sixth embodiment of the burner, FIG. 7 shows a first embodiment of the fine solids feeding apparatus, FIG. 8 shows a second embodiment of the fine solids feeding apparatus, FIG. 9 shows a third embodiment of the fine solids feeding apparatus, FIG. 10 shows a fourth embodiment of the fine solids feeding apparatus, FIG. 11 shows a fifth embodiment of the fine solids feeding apparatus, and FIG. 12 shows a sixth embodiment of the fine solids feeding apparatus.

DETAILED DESCRIPTION OF THE INVENTION

The invention relates to a burner such as a concentrate burner, a calcine burner, or a matte burner, or a burner using a mixture of these for feeding reaction gas and fine solids into a reaction shaft of a suspensions smelting furnace, and to a fine solids feeding apparatus for a burner such as a concentrate burner, a calcine burner, or a matte burner, or a burner using a mixture of these.

First the burner and some embodiments and variants of the burner will be described in greater detail.

The burner comprises a fine solids discharge channel 1 that is radially outwardly limited by a wall 3 of the fine solids discharge channel 1 and that is radially inwardly limited by a fine solids dispersion device 3 arranged in the fine solids discharge channel 1 so that the fine solids discharge channel 1 has an annular cross-section.

The burner comprises an annular reaction gas channel 4 that surrounds the fine solids discharge channel 1 and that is radially outwardly limited by a reaction gas channel wall 5 of the reaction gas channel 4 and that is radially inwardly limited by the wall 3 of the fine solids discharge channel 1.

The fine solids dispersion device 3 has dispersion gas openings 6 and a dispersion gas channel 7 for conducting dispersion gas to the dispersion gas openings 6.

The fine solids dispersion device 3 extends out of a downstream outlet end 8 of the fine solids discharge channel 1.

The fine solids dispersion device 3 has at the downstream outlet end 8 of the fine solids discharge channel 1 an enlarged section 9, where the diameter of the fine solids dispersion device 3 increases in the direction towards a free distal end 10 of the fine solids dispersion device 3.

The burner comprises gas outlets 11 in the fine solids discharge channel 1 upstream of the downstream outlet end 8 of the fine solids discharge channel 1.

The gas outlets 11 comprise spiral path guiding members such as a circumferential row of individual nozzles configured to facilitate gas to flow from the gas outlets 11 in a spiral flow path around a center axis A of the fine solids discharge channel 1. The gas outlet flow momentum and the inclination angle, from the vertical axis, of the gas discharge must be sufficient in order to induce a rotational movement on the fine solid flow. Suitable discharge angle, from the vertical axis, of the spiral guiding members or the individual nozzles is between 30° and 150°. Suitable discharge velocity of the spiral guiding members or the circumferential row of individual nozzles is between 5 m/s and 300 m/s, depending on the fine solid feed rate, gas composition and the vertical location of the gas discharge. The discharge velocity is regulated using flow control of the gas.

The gas can for example be or comprise nitrogen or oxygen.

The burner can comprise partition walls 12 in the fine solids discharge channel 1 upstream of the gas outlets 11 in the fine solids discharge channel 1, wherein the partition walls 12 dividing the fine solids discharge channel 1 into sectors, and wherein the partition walls 12 being planar and extending in the direction of the center axis A of the fine solids discharge channel 1. If the burner comprise such partition walls 12, the distance between the partition walls 12 and the downstream outlet end 8 of the fine solids discharge channel 1 is preferably, but not necessarily, between 0.1 and 3 m, such as between 0.5 and 1.5 m.

The burner can comprise an annular gas channel 13 between the annular reaction gas channel 4 and the dispersion gas channel 7 of the fine solids dispersion device 3, as shown in FIGS. 1 to 6.

The burner can comprise an annular gas channel 13 between the annular reaction gas channel 4 and the dispersion gas channel 7 of the fine solids dispersion device 3 so that the annular gas channel 13 is arranged in the fine solids discharge channel 1, as shown in FIGS. 1 and 2.

The burner can comprise an annular gas channel 13 between the annular reaction gas channel 4 and the dispersion gas channel 7 of the fine solids dispersion device 3 so that the annular gas channel 13 is arranged in the fine solids discharge channel 1 at the fine solids dispersion device 3, as shown in FIG. 1.

The burner can comprise an annular gas channel 13 between the annular reaction gas channel 4 and the dispersion gas channel 7 of the fine solids dispersion device 3 so that the annular gas channel 13 is arranged in the fine solids discharge channel 1 at the fine solids discharge channel wall 2 of the fine solids discharge channel 1, as shown in FIG. 2

The burner can comprise an annular gas channel 13 between the annular reaction gas channel 4 and the dispersion gas channel 7 of the fine solids dispersion device 3 so that the annular gas channel 13 being provided in the fine solids dispersion device 3, as shown in FIG. 3.

The burner can comprise an annular gas channel 13 between the annular reaction gas channel 4 and the dispersion gas channel 7 of the fine solids dispersion device 3 so that the annular gas channel 13 being provided in the fine solids discharge channel wall 2 of the fine solids discharge channel 1, as shown in FIG. 4.

The burner can comprise a first set of gas outlets 11 arranged upstream of the downstream outlet end 8 of the fine solids discharge channel 1 at a first distance from the downstream outlet end 8 of the fine solids discharge channel 1, and second set of gas outlets 11 arranged upstream of the downstream outlet end 8 of the fine solids discharge channel 1 at a second distance from the downstream outlet end 8 of the fine solids discharge channel 1, wherein the second distance is longer than the first distance, as is shown in FIG. 5.

The burner can comprise an annular gas channel 13 between the annular reaction gas channel 4 and the dispersion gas channel 7 of the fine solids dispersion device 3 so that the annular gas channel 13 is provided at a distance from the fine solids discharge channel wall 2 and at a distance from the fine solids dispersion device 3, as shown in FIG. 6.

The gas openings are preferably, but not necessarily, arranged in the fine solids discharge channel 1 upstream of the enlarged section 9 of the fine solids dispersion device 3.

Next the fine solids feeding apparatus for a burner such as a concentrate burner, a calcine burner, or a matte burner, or a burner using a mixture of these and some embodiments and variants of the fine solids feeding apparatus will be described in greater detail.

The fine solids feeding apparatus comprises a fine solids discharge channel 1 that is radially outwardly limited by a fine solids discharge channel wall 2 of the fine solids discharge channel 1 and that is radially inwardly limited by a fine solids dispersion device 3 arranged in the fine solids discharge channel 1 so that the fine solids discharge channel 1 has an annular cross-section.

The fine solids dispersion device 3 has dispersion gas openings 6 and a dispersion gas channel 7 for conducting dispersion gas to the dispersion gas openings 6.

The fine solids dispersion device 3 extends out of a downstream outlet end 8 of the fine solids discharge channel 1.

The fine solids dispersion device 3 has at the downstream outlet end 8 of the fine solids discharge channel 1 an enlarged section 9, where the diameter of the fine solids dispersion device 3 increases in the direction towards a free distal end 10 of the fine solids dispersion device 3.

The fine solids feeding apparatus comprises gas outlets 11 in the fine solids discharge channel 1 upstream of the downstream outlet end 8 of the fine solids discharge channel 1.

The gas outlets 11 comprise spiral path guiding members such as a circumferential row of individual nozzles configured to facilitate gas to flow from the gas outlets 11 in a spiral flow path around a center axis A of the fine solids discharge channel 1. The gas outlet flow momentum and the inclination angle, from the vertical axis, of the gas discharge must be sufficient in order to induce a rotational movement on the fine solid flow. Suitable discharge angle, from the vertical axis, of the spiral guiding members or the individual nozzles is between 30° and 150°. Suitable discharge velocity of the spiral guiding members or the circumferential row of individual nozzles is between 5 m/s and 300 m/s, depending on the fine solid feed rate, gas composition and the vertical location of the gas discharge. The discharge velocity is regulated using flow control of the gas.

The gas can for example be or comprises nitrogen or oxygen.

The fine solids feeding apparatus can comprise partition walls 12 in the fine solids discharge channel 1 upstream of the gas outlets 11 in the fine solids discharge channel 1, wherein the partition walls 12 dividing the fine solids discharge channel 1 into sectors, and wherein the partition walls 12 being planar and extending in the direction of the center axis A of the fine solids discharge channel 1. If the burner comprise such partition walls 12, the distance between the partition walls 12 and the downstream outlet end 8 of the fine solids discharge channel 1 is preferably, but not necessarily, between 0.1 and 3 m, such as between 0.5 and 1.5 m.

The fine solids feeding apparatus can comprise an annular gas channel 13 surrounding the dispersion gas channel 7 of the fine solids dispersion device 3, as shown in FIGS. 7 to 12.

The fine solids feeding apparatus can comprise an annular gas channel 13 surrounding the dispersion gas channel 7 of the fine solids dispersion device 3 so that the annular gas channel 13 is arranged in the fine solids discharge channel 1, as shown in FIGS. 7 and 8.

The fine solids feeding apparatus can comprise an annular gas channel 13 surrounding the dispersion gas channel 7 of the fine solids dispersion device 3 so that the annular gas channel 13 is arranged in the fine solids discharge channel 1 at the fine solids dispersion device 3, as shown in FIG. 7.

The fine solids feeding apparatus can comprise an annular gas channel 13 surrounding the dispersion gas channel 7 of the fine solids dispersion device 3 so that the annular gas channel 13 is arranged in the fine solids discharge channel 1 at the fine solids discharge channel wall 2 of the fine solids discharge channel 1, as shown in FIG. 8

The fine solids feeding apparatus can comprise an annular gas channel 13 surrounding the dispersion gas channel 7 of the fine solids dispersion device 3 so that the annular gas channel 13 being provided in the fine solids dispersion device 3, as shown in FIG. 9.

The fine solids feeding apparatus can comprise an annular gas channel 13 surrounding the dispersion gas channel 7 of the fine solids dispersion device 3 so that the annular gas channel 13 being provided in the fine solids discharge channel wall 2 of the fine solids discharge channel 1, as shown in FIG. 10.

The fine solids feeding apparatus can comprise a first set of gas outlets 11 arranged upstream of the downstream outlet end 8 of the fine solids discharge channel 1 at a first distance from the downstream outlet end 8 of the fine solids discharge channel 1, and second set of gas outlets 11 arranged upstream of the downstream outlet end 8 of the fine solids discharge channel 1 at a second distance from the downstream outlet end 8 of the fine solids discharge channel 1, wherein the second distance is longer than the first distance, as is shown in FIG. 11.

The fine solids feeding apparatus can comprise an annular gas channel 13 surrounding the dispersion gas channel 7 of the fine solids dispersion device 3 so that the annular gas channel 13 is provided at a distance from the fine solids discharge channel wall 2 and at a distance from the fine solids dispersion device 3, as shown in FIG. 12.

The gas openings are preferably, but not necessarily, arranged in the fine solids discharge channel 1 upstream of the enlarged section 9 of the fine solids dispersion device 3.

The invention relates also to a burner comprising a fine solids feeding apparatus as described above.

It is apparent to a person skilled in the art that as technology advanced, the basic idea of the invention can be implemented in various ways. The invention and its embodiments are therefore not restricted to the above examples, but they may vary within the scope of the claims.

The invention claimed is:

1. A fine solids feeding apparatus for a burner, wherein the fine solids feeding apparatus comprises:

a fine solids discharge channel that is radially outwardly limited by a fine solids discharge channel wall of the fine solids discharge channel and that is radially inwardly limited by a fine solids dispersion device arranged in the fine solids discharge channel so that the fine solids discharge channel has an annular cross-section, wherein the fine solids dispersion device has dispersion gas openings and a dispersion gas channel for conducting dispersion gas to the dispersion gas openings, wherein the fine solids dispersion device extends out of a downstream outlet end of the fine solids discharge channel, and wherein the fine solids dispersion device has at the downstream outlet end of the fine solids discharge channel an enlarged section, where the diameter of the fine solids dispersion device increases in the direction towards a free distal end of the fine solids dispersion device, wherein the fine solids feeding apparatus further comprises:

gas outlets in the fine solids discharge channel upstream of the downstream outlet end of the fine solids discharge channel, wherein the gas outlets comprise spiral path guiding members configured to facilitate gas to flow from the gas outlets in a spiral flow path around a center axis A of the fine solids discharge channel, partition walls in the fine solids discharge channel upstream of the gas outlets in the fine solids discharge channel, wherein the partition walls divide the fine solids discharge channel into sectors, wherein the partition walls are planar and extend in the direction of the center axis A of the fine solids discharge channel, and wherein a distance between the partition walls and the downstream outlet end of the fine solids discharge channel is between 0.1 and 1.5 m.

2. The fine solids feeding apparatus according to claim 1, comprising an annular gas channel surrounding the dispersion gas channel of the fine solids dispersion device.

3. The fine solids feeding apparatus according to claim 2, wherein the annular gas channel is arranged in the fine solids discharge channel.

4. The fine solids feeding apparatus according to claim 3, wherein the annular gas channel is arranged at the fine solids dispersion device.

5. The fine solids feeding apparatus according to claim 3, wherein the annular gas channel is arranged at the fine solids discharge channel wall of the fine solids discharge channel.

6. The fine solids feeding apparatus according to claim 3, wherein the annular gas channel is provided at a distance from the fine solids discharge channel wall and at a distance from the fine solids dispersion device.

7. The fine solids feeding apparatus according to claim 2, wherein the annular gas channel is provided in the fine solids dispersion device.

8. The fine solids feeding apparatus according to claim 2, wherein the annular gas channel is provided in the fine solids discharge channel wall of the fine solids discharge channel.

9. The fine solids feeding apparatus according to claim 1, wherein the dispersion gas openings are arranged in the fine solids discharge channel upstream of the enlarged section of the fine solids dispersion device.

10. The fine solids feed apparatus according to claim 1, wherein the burner is selected from the group consisting of a concentrate burner, a calcine burner, a matte burner, and mixtures thereof.

11. A burner comprising a fine solids feeding apparatus according to claim 1.

* * * * *